US009223245B2

(12) United States Patent
Oikawa et al.

(10) Patent No.: US 9,223,245 B2
(45) Date of Patent: Dec. 29, 2015

(54) DEVELOPING DEVICE TO FORM A UNIFORM DEVELOPER LAYER ON A DEVELOPING MEMBER AND ELECTROPHOTOGRAPHIC IMAGE FORMING APPARATUS USING THE SAME

(71) Applicants: Mitsuru Oikawa, Suwon-si (KR); Sang-don Lee, Gwacheon-si (KR); Jong-pil Jun, Hwaseong-si (KR)

(72) Inventors: Mitsuru Oikawa, Suwon-si (KR); Sang-don Lee, Gwacheon-si (KR); Jong-pil Jun, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 36 days.

(21) Appl. No.: 13/667,726

(22) Filed: Nov. 2, 2012

(65) Prior Publication Data

US 2013/0279945 A1 Oct. 24, 2013

(30) Foreign Application Priority Data

Apr. 19, 2012 (KR) ..... 10-2012-0041146

(51) Int. Cl.
*G03G 15/00* (2006.01)
*G03G 15/08* (2006.01)
*G03G 15/09* (2006.01)

(52) U.S. Cl.
CPC ..... *G03G 15/0812* (2013.01); *G03G 15/09* (2013.01); *G03G 2215/0609* (2013.01)

(58) Field of Classification Search
CPC ..... G03G 15/0812; G03G 15/09; G03G 2215/0609
USPC ..... 399/274, 284
See application file for complete search history.

(56) References Cited

U.S. PATENT DOCUMENTS 5,583,622 A 12/1996 Nishimura
6,070,037 A * 5/2000 Sugihara et al. ..... 399/274
6,321,056 B1 11/2001 Takami
(Continued)

FOREIGN PATENT DOCUMENTS

JP 2003-122113 4/2003
JP 2003-140461 5/2003
(Continued)

OTHER PUBLICATIONS

English Translation of Tateyama et al. Developing Device, Process Cartridge, and Image Forming Apparatus. Oct. 29, 2009. Japanese Patent Office. JP2009-251317.*
Extended European Search Report dated Sep. 3, 2014 in corresponding European Patent Application No. 12193766.8.

*Primary Examiner* — Clayton E Laballe
*Assistant Examiner* — Trevor J Bervik
(74) *Attorney, Agent, or Firm* — Staas & Halsey LLP

(57) ABSTRACT

A developing device to supply toner in a developer, including a development member which receives the developer on an outer circumferential surface thereof and supplies the toner to the image bearing member, a first regulation member including a first regulating portion that forms a first doctor gap between the outer circumferential surface of the development member and the first regulating portion, and a second regulation member disposed on an upstream side of the first regulation member in a rotational direction of the development member and includes a second regulating portion that forms a second doctor gap between the outer circumferential surface of the development member and the second regulating portion, the second doctor gaps at a central portion and both end portions in a longitudinal direction of the development member being different from each other.

16 Claims, 7 Drawing Sheets

(56) References Cited

U.S. PATENT DOCUMENTS

| | | | | |
|---|---|---|---|---|
| 6,978,108 | B2 * | 12/2005 | Sakamaki | 399/267 |
| 7,171,145 | B2 | 1/2007 | Takeuchi et al. | |
| 7,289,755 | B2 | 10/2007 | Terai | |
| 7,406,280 | B2 | 7/2008 | Tomita et al. | |
| 7,515,856 | B2 | 4/2009 | Ohyama | |
| 7,620,351 | B2 * | 11/2009 | Onda et al. | 399/274 |
| 8,019,257 | B2 * | 9/2011 | Ishida et al. | 399/274 |
| 2003/0235437 | A1 | 12/2003 | Sakamaki | |
| 2008/0298848 | A1 | 12/2008 | Lee | |
| 2012/0039638 | A1 * | 2/2012 | Park | 399/274 |

FOREIGN PATENT DOCUMENTS

| | | | |
|---|---|---|---|
| JP | 2005-091953 | | 4/2005 |
| JP | 2005-257864 | | 9/2005 |
| JP | 2007-025463 | | 2/2007 |
| JP | 2008-122459 | | 5/2008 |
| JP | 2008-139585 | | 6/2008 |
| JP | 2008-139650 | | 6/2008 |
| JP | 2009251317 | A * | 10/2009 |
| JP | 2012-037893 | | 2/2012 |
| KR | 2008-0106693 | | 9/2008 |

* cited by examiner

DEVELOPING DEVICE TO FORM A UNIFORM DEVELOPER LAYER ON A DEVELOPING MEMBER AND ELECTROPHOTOGRAPHIC IMAGE FORMING APPARATUS USING THE SAME

CROSS-REFERENCE TO RELATED APPLICATIONS

This application claims priority under 35 U.S.C. §119 from Korean Patent Application No. 10-2012-0041146, filed on Apr. 19, 2012, in the Korean Intellectual Property Office, the disclosure of which is incorporated herein in its entirety by reference.

BACKGROUND

1. Field

The present general inventive concept relates to a developing device using a dual-component developer including toner and a magnetic carrier, and an image forming apparatus using the developing device.

2. Description of the Related Art

In an electrophotographic image forming apparatus, light that is modulated to correspond to image information is emitted to a photoconductor to form an electrostatic latent image on a surface of the photoconductor, toner is supplied to the electrostatic latent image to develop the electrostatic latent image into a visible toner image, and then the visible toner image is transferred and fused onto a recording medium, thereby printing an image on the recording medium.

An image forming method of an electrophotographic image forming apparatus may be classified into a mono-component development method using a mono-component developer including toner, or a dual-component development method using a dual-component developer including toner and a carrier in which only the toner is used for development on a photoconductor.

In an image forming apparatus using a dual-component development method, a thickness of a developer attached to an outer circumferential surface of a developing roller is regulated by a first regulation member that is spaced apart by a predetermined distance from the outer circumferential surface of the developing roller. In order to obtain a high-quality printed image, a thickness of a developer layer supplied to a development area where the developing roller and a photoconductor face needs to be uniform. If the thickness of the developer layer is not uniform, image density irregularity or toner scattering may occur.

SUMMARY

The present general inventive concept provides a developing device that ensures high image quality by forming a uniform developer layer in a longitudinal direction of a development member, and an image forming apparatus using the developing device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a developing device to perform development by supplying toner in a developer in which the toner and a carrier are mixed to an electrostatic latent image formed on an image bearing member, the developing device including a development member to attach the developer to an outer circumferential surface of the development member and supply the toner to the image bearing member, a first regulation member that includes a first regulating portion to form a first doctor gap between the outer circumferential surface of the development member and the first regulating portion, and a second regulation member disposed on an upstream side of the first regulation member in a rotational direction of the development member and includes a second regulating portion to form second doctor gaps between the outer circumferential surface of the development member and the second regulating portion, wherein the second doctor gaps at a central portion and both end portions in a longitudinal direction of the development member are different from each other.

The second doctor gaps at the both end portions may be less than the second doctor gap at the central portion.

The first regulating portion and the second regulating portion may face a same magnetic pole of the development member.

The second doctor gaps may be greater than the first doctor gap.

A difference between the second doctor gap at the central portion and the second doctor gaps at the both end portions may be equal to or less than 1 mm.

The second doctor gaps at the both end portions may range from about 0.5 mm to about 2.0 mm.

The foregoing and/or other features and utilities of the present general inventive concept may also be achieved by providing a developing device to perform development by supplying toner of a developer in which the toner and a carrier are mixed to an electrostatic latent image formed on an image bearing member, the developing device including a development member to attach a developer to an outer circumferential surface of the development member and supply the toner to the image bearing member, a first regulating portion to form a first doctor gap between the outer circumferential surface of the development member and the first regulating portion, and a second regulating portion disposed on an upstream side of the first regulating portion in a rotational direction of the development member to form different pressures of the developer at both end portions and a central portion in a longitudinal direction of the development member.

The second regulation member may form the different pressures such that the pressure of the developer at the both end portions is higher than the pressure of the developer at the central portion.

The second regulating portion may form second doctor gaps between the outer circumferential surface of the development member and the second regulating portion, wherein the second doctor gaps at the both end portions is less than the second doctor gap at the central portion.

A difference between the second doctor gap at the central portion and the second doctor gap at the both end portions may be equal to or less than 1 mm.

The second doctor gap at the both end portions may range from about 0.5 mm to about 2.0 mm.

The foregoing and/or other features and utilities of the present general inventive concept may also be achieved by providing an electrophotographic image forming apparatus using a developer in which toner and a carrier are mixed, the electrophotographic image forming apparatus including an image bearing member on which an electrostatic latent image is formed and a developing device to perform development by supplying toner of a developer in which the toner and a carrier are mixed to an electrostatic latent image formed on an image bearing member, the developing device including a development member to attach a developer to an outer circumferential surface of the development member and supply the toner to the image bearing member, a first regulating portion to form a first doctor gap between the outer circumferential surface of the development member and the first regulating portion, and a second regulating portion disposed on an upstream side of the first regulating portion in a rotational direction of the development member to form different pressures of the developer at both end portions and a central portion in a longitudinal direction of the development member.

The second doctor gaps at the both end portions may be less than the second doctor gap at the central portion.

The first regulating portion and the second regulating portion may face a same magnetic pole of the development member.

The second doctor gaps may be greater than the first doctor gap.

A difference between the second doctor gap at the central portion and the second doctor gaps at the both end portions may be equal to or less than 1 mm.

The second doctor gaps at the both end portions may range from about 0.5 mm to about 2.0 mm.

The foregoing and/or other features and utilities of the present general inventive concept may also be achieved by providing a developing device to supply toner in a developer to a photosensitive drum to form an image on a printing medium, the developing device including a developing roller having an outer circumferential surface to attach the developer thereto and to supply the toner to the photosensitive drum, a first regulation member to form a first doctor gap with the outer circumferential surface of the developing roller, and a second regulation member disposed upstream of the first regulation member to form second doctor gaps with the outer circumferential surface of the developing roller that are larger than the first doctor gap, at least one of the second doctor gaps being different in size than the remaining second doctor gaps.

The second regulating member may uniformly distribute pressure and density of the developer along a length of the outer circumferential surface of developing roller.

The second regulating member may include a central portion to form the at least one of the second doctor gaps to be larger in size than the remaining second doctor gaps.

The central portion may be longer than a width of the printing medium.

The second doctor gaps may have different sizes.

BRIEF DESCRIPTION OF THE DRAWINGS

The above and other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
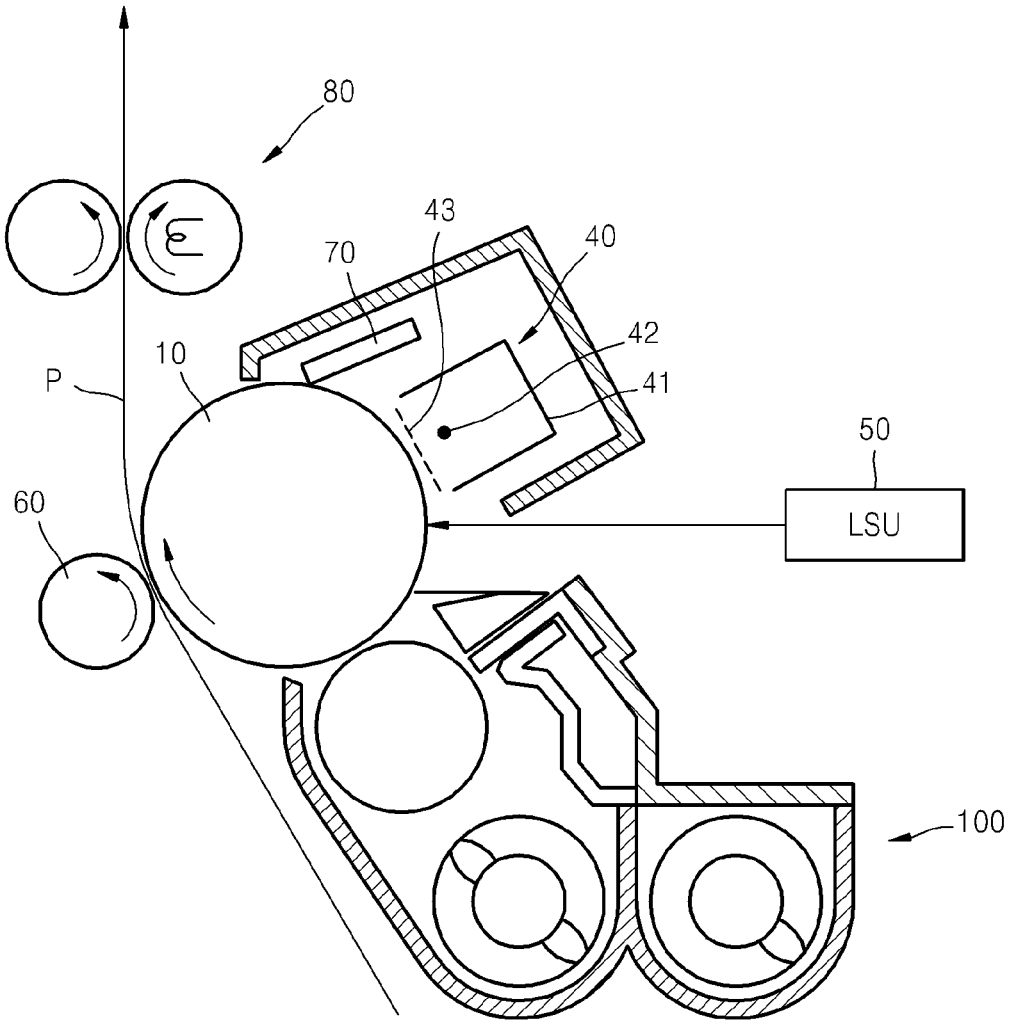
FIG. 1 is a cross-sectional view illustrating an electrophotographic image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a cross-sectional view illustrating an electrophotographic image forming apparatus according to an exemplary embodiment of the present general inventive concept. The image forming apparatus may be a monochromic image forming apparatus using a dual-component developer including toner and a magnetic carrier. The toner may have, for example, a black color, but is not limited thereto.

A photosensitive drum 10, which is an image bearing member on which an electrostatic latent image is formed, is obtained by forming a photosensitive layer with photoconductivity on an outer circumferential surface of a cylindrical metal pipe. Instead of the photosensitive drum 10, a photosensitive belt obtained by forming a photosensitive layer on an outer surface of a belt that circulates may be used.

A charger 40 charges a surface of the photosensitive drum 10 to a uniform charge potential. The charger 40 may be, for example, a corona charger that charges the surface of the photosensitive drum 10 by causing a corona discharge by applying a bias voltage between a plate electrode 41 and a wire electrode 42, but is not limited thereto. To perform uniform charging, the image forming apparatus may further include a grid electrode 43. Further in the charger 40, a charging roller (not illustrated) that rotates while contacting the photosensitive drum 10 and allows a charge bias voltage to be applied thereto, may be used.

An exposure unit 50 forms an electrostatic latent image on the photosensitive drum 10 by emitting light corresponding to image information to a surface of the photosensitive drum 10, which has been charged. The exposure unit 50 may include a laser scanning unit (LSU) that reflects light emitted from a laser diode (not illustrated) to the photosensitive drum 10 in a main scanning direction by using a polygon mirror (not illustrated), but the present embodiment is not limited thereto.

Figure 2A:
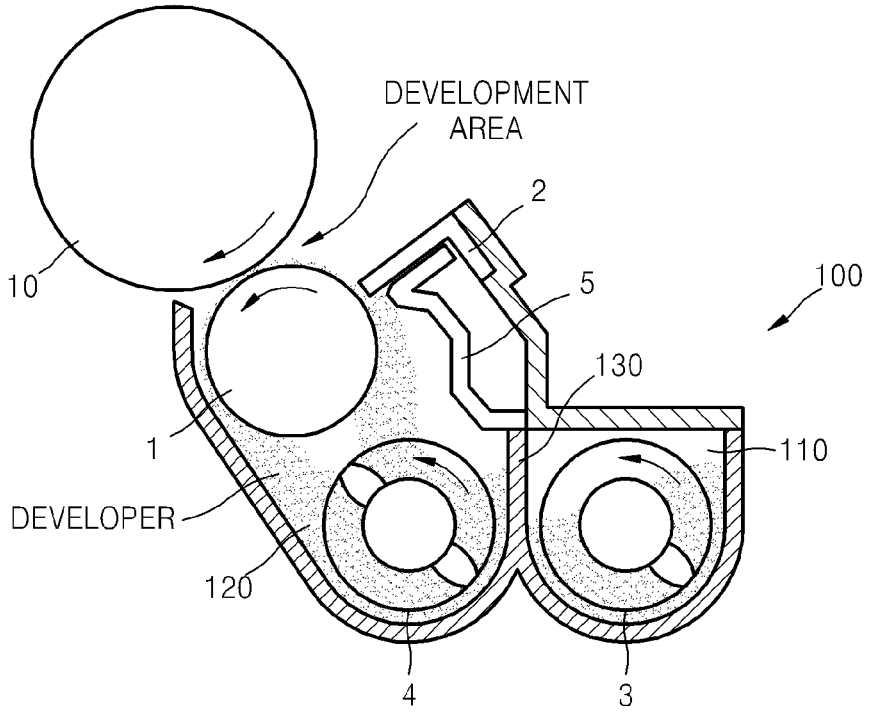
FIG. 2A is a cross-sectional view illustrating a developing device of the electrophotographic image forming apparatus of FIG. 1.

As illustrated in FIGS. 1 and 2A, a developer is contained in a developing device 100. The developing device 100 forms a visible toner image on the surface of the photosensitive drum 10 by supplying toner of the developer to the electrostatic latent image formed on the photosensitive drum 10.

A transfer roller 60 is a transfer unit that transfers the toner image formed on the photosensitive drum 10 to a recording medium P. The transfer roller 60 forms a transfer nip by facing the photosensitive drum 10, and a transfer bias voltage is applied to the transfer roller 60. Due to a transfer electric field formed between the photosensitive drum 10 and the transfer roller 60 due to the transfer bias voltage, the toner image developed on the surface of the photosensitive drum 10 is transferred to a recording medium P. Instead of the transfer roller 60, a corona transfer unit using a corona discharge may be used. After the transfer of the toner image to the recording medium P is completed, a portion of the toner remaining on the surface of the photosensitive drum 10 is removed by using a cleaning blade 70.

The toner image transferred to the recording medium P is attached to the recording medium P due to an electrostatic force. A fusing unit 80 fuses the toner image onto the recording medium P by using heat and pressure.

Figure 2B:
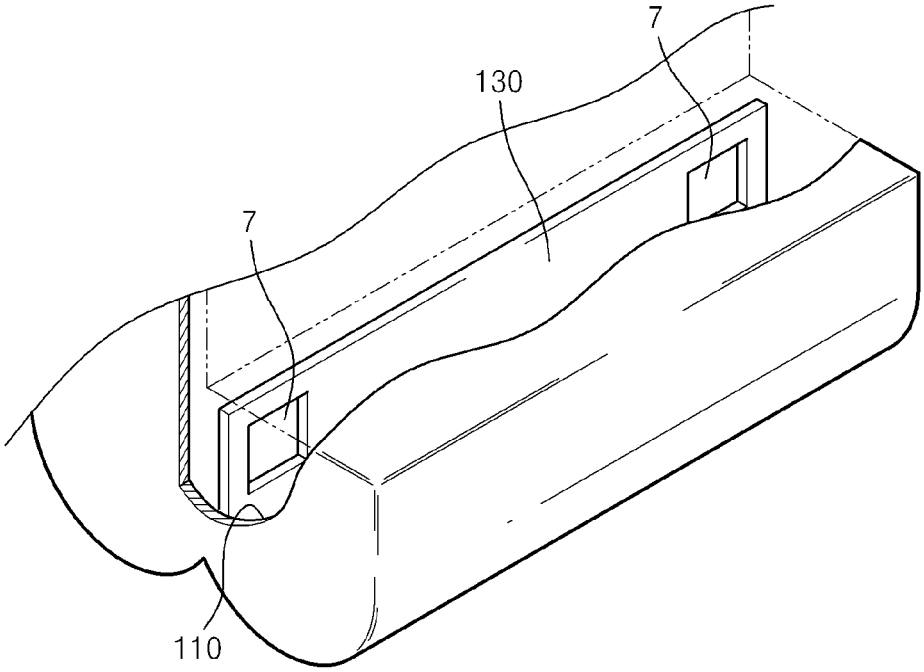
FIG. 2B is an angled view illustrating a developing device of the electrophotographic image forming apparatus of FIG. 1.

FIG. 2A is a cross-sectional view illustrating the developing device 100 of the image forming apparatus of FIG. 1, and FIG. 2B is an angled view illustrating the developing device 100 of the image forming apparatus of FIG. 1. Referring to FIG. 2A, the developer contained in the developing device 100 is agitated by first and second agitators 3 and 4 and then is fed to the developing roller 1. During the agitation, the toner and the carrier rub with each other and thus the toner is charged. The developing device 100 may include a first area 110 in which the first agitator 3 is disposed, and a second area 120 in which the second agitator 4 and the developing roller 1 are disposed. The first area 110 and the second area 120 are divided by a partition 130 that extends in a longitudinal direction of the developing roller 1. Referring to FIG. 2B, openings 7 may be formed on both end portions of the partition 130 in a longitudinal direction of the partition 130, that is, the longitudinal direction of the developing roller 1. The first area 110 and the second area 120 may communicate with each other through the openings 7. The first and second agitators 3 and 4 may be, for example, augers each of which includes a shaft that extends in the longitudinal direction of the developing roller 1 and a spiral wing that is formed on an outer circumferential surface of the shaft. When the first agitator 3 rotates, the developer in the first area 110 is delivered in an axial direction of the first agitator 3, passes through the opening 7 formed on one end portion of the partition 130, and is delivered to the second area 120. The developer in the second area 120 is delivered by the second agitator 4 in an axial direction of the second agitator 4 which is opposite to a direction in which the developer is delivered by the first agitator 3, passes through the opening formed on the other end portion of the partition 130, and is delivered to the first area 110. Accordingly, the developer circulates along the first area 110 and the second area 120. During the circulation, the developer is supplied to the developing roller 1 located in the second area 120.

As the toner is delivered to the photosensitive drum 10 from the developing roller 1, the amount of the toner remaining in the first and second areas 110 and 120 is reduced. A toner concentration sensor (not illustrated) to detect a concentration of the toner in the developer may be provided in the developing device 100. The toner concentration sensor may be disposed in, for example, the first area 110. A concentration of the toner may be represented as a ratio of a weight of the toner to a total weight of the developer. The toner concentration sensor may be, for example, a magnetic sensor to directly or indirectly detect a concentration of the toner by measuring an intensity of a magnetic force due to the magnetic carrier within the developer. When the magnetic carrier is greater than the toner in a detection area, an intensity of a magnetic force detected by the magnetic sensor in the detection area is increased, and when the toner is greater than the magnetic carrier in the detection area, an intensity of a magnetic force detected by the magnetic sensor in the detection area is reduced. The magnetic sensor may detect a concentration of the toner by using a relationship between the intensity of the magnetic field detected and the concentration of the toner. Alternatively, the toner concentration sensor may be a capacitive sensor to detect a concentration of the toner by using a difference between dielectric indices of the carrier and the toner. When the concentration of the toner detected by the toner concentration sensor is less than a standard toner concentration, toner may be added to the toner in the developing device 100. For example, toner may be added to the first area 110 from, for example, a toner container (not illustrated). As such, the concentration of the toner in the developing device 100 may be maintained constant. The toner container may be integrally formed with the developing device 100. Alternatively, the toner container may be separated from the developing device 100, and may be individually replaced. The standard toner concentration may be set to, for example, about 7%, but the present embodiment is not limited thereto.

Figure 3:
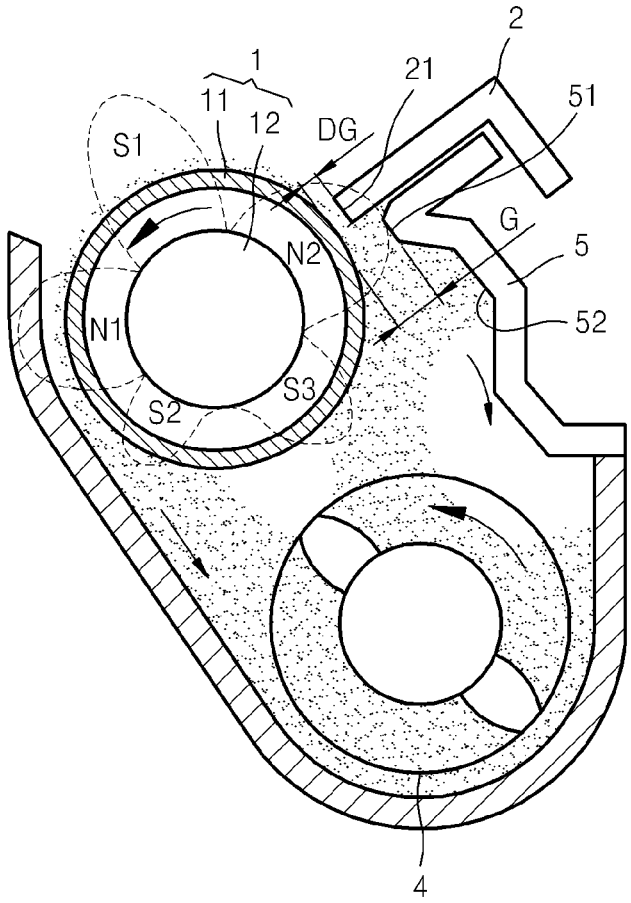
FIG. 3 is a cross-sectional view illustrating a second area of the developing device of FIG. 2.

The developing roller 1 is a development member that supplies the toner to the surface of the photosensitive drum 10. The developing roller 1 is disposed to face the photosensitive drum 10. The developing roller 1 may be spaced apart by a development gap from the photosensitive drum 10. The development gap refers to an interval between an outer circumferential surface of the photosensitive drum 10 and an outer circumferential surface of the developing roller 1. The development gap may be set to range from about tens of microns to about several hundreds of microns. FIG. 3 is a cross-sectional view illustrating the second area 120 of the developing device of FIG. 2A. Referring to FIG. 3, the developing roller 1 may include a sleeve 11 that rotates, and a magnet 12 disposed within the sleeve 11. The magnet 12 may not rotate. Alternatively, the magnet 12 may rotate in the sleeve 11. Rotational directions of the sleeve 11 and the photosensitive drum 10 may be opposite. That is, rotational directions of surfaces of the sleeve 11 and the photosensitive drum 10 at an area where the sleeve 11 and the photosensitive drum 10 face each other may be the same. However, the present embodiment is not limited thereto, and rotational directions of the sleeve 11 and the photosensitive drum 10 may be the same.

In the second area 120, the carrier is attached to the outer circumferential surface of the developing roller 1 due to a magnetic force of the magnet 12, and the toner is attached to the carrier due to an electrostatic force. Then, a developer layer including the carrier and the toner is formed on the outer circumferential surface of the developing roller 1. A first regulation member 2 regulates a thickness of the developer layer to a predetermined thickness. In general, the first regulation member 2 may be called a doctor blade. The first regulation member 2 includes a first regulating portion 21. There is an interval, that is, a first doctor gap DG, between the first regulating portion 21 and the outer circumferential surface of the developing roller 1. The first doctor gap DG may be set to range from about 0.3 mm to about 1.5 mm.

The magnet 12 may include a plurality of magnetic poles. The plurality of magnetic poles may include a main pole S1 that faces the photosensitive drum 10, and a carrying pole N1, a separation pole S2, a reception pole S3, and a regulation pole N2 which are sequentially arranged from the main pole S1 in a rotational direction of the sleeve 11. The developer in the second area 120 carried by the second agitator 4 is adhered to the outer circumferential surface of the sleeve 11 due to a magnetic force of the reception pole S3. In detail, the carrier is attached to the outer circumferential surface of the sleeve 11 due to the magnetic force of the reception pole S3, and the toner is attached to the magnetic carrier by an electrostatic force. Accordingly, the developer layer is formed on the outer circumferential surface of the sleeve 11. As the sleeve 11 rotates, the developer layer is sequentially delivered from the regulation pole N2, to the main pole S1, the carrying pole N1, and the separation pole S2. The developer at the separation pole S2 is separated from the sleeve 11, retrieved to the second area, and circulated along the first area 110 and the second area 120 by the first agitator 3 and the second agitator 4, respectively.

A process of circulating the developer throughout the developing device 100 will be explained in detail. The developer layer formed on the outer circumferential surface of the sleeve 11 due to the magnetic force of the reception pole S3 is carried to the regulation pole N2 as the sleeve 11 rotates. The first regulation member 2 is disposed to face the regulation pole N2. As the sleeve 11 rotates, the developer layer passes through the first doctor gap DG, so that a thickness of the developer layer is regulated. Accordingly, a portion of the developer layer having a predetermined thickness passes through the first doctor gap DG and a remaining portion of the developer layer is blocked by the first regulation member 2 and is retrieved to the second area 120. The developer layer whose thickness has been regulated is delivered to the main pole S1 as the sleeve 11 rotates. The main pole S1 is located at a development area where the sleeve 11 and the photosensitive drum 10 face each other. In the development area, due to a development bias voltage applied to the sleeve 11, the toner of the developer layer formed on the surface of the sleeve 11 passes through the development gap and is attached to the electrostatic latent image formed on the surface of the photosensitive drum 10. After passing through the development area, a portion of the developer layer remaining on the outer circumferential surface of the sleeve 11 passes through the carrier pole N1, is delivered to the separation pole S2, is separated from the outer circumferential surface of the sleeve 11 at the separation pole S2, and is retrieved to the second area 120.

A process of forming an image by using the developing device 100 constructed as described above will be explained briefly. When a charge bias voltage is applied to the charger 40, the surface of the photosensitive drum 10 is charged to a uniform potential. The exposure unit 50 forms an electrostatic latent image by emitting light corresponding to image information to the surface of the photosensitive drum 10. When a development bias voltage is applied to the developing roller 1 and a development electric field is formed between the developing roller 1 and the photosensitive drum 10, the toner is moved from a developer layer formed on the surface of the developing roller 1 to the surface of the photosensitive drum 10 to develop the electrostatic latent image. A toner image is formed on the surface of the photosensitive drum 10. The recording medium P is fed from a paper feeding unit (not illustrated) to the transfer nip where the photosensitive drum 10 and the transfer roller 60 face each other. Due to a transfer electric field formed due to the transfer bias voltage, the toner image is moved from the surface of the photosensitive drum 10 to the recording medium P and is attached to the recording medium P. When the recording medium P passes through the fusing unit 80, the toner image is fused onto the recording medium P due to heat and pressure, thereby completing image printing. The cleaning blade 70 contacts the surface of the photosensitive drum 10, and removes a portion of the toner remaining on the surface of the photosensitive drum 10 after the transferring.

In order to obtain a high-quality printed image, a thickness of a developer layer supplied to a development area through the first doctor gap DG has to be uniform in a longitudinal direction of the developing roller 1.

Figure 4:
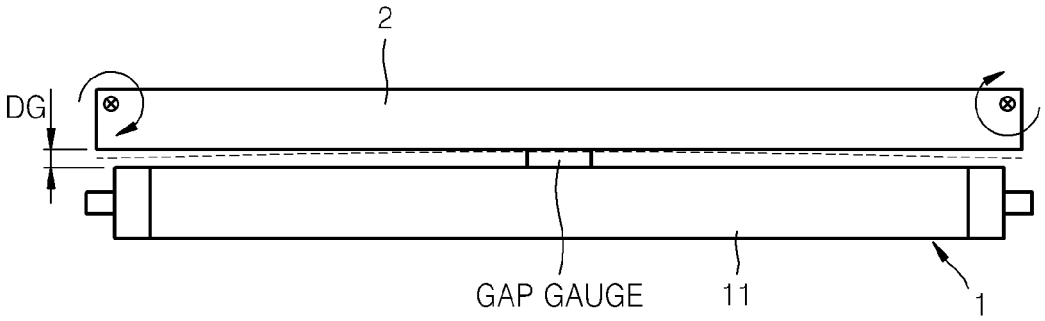
FIG. 4 is a cross-sectional view illustrating irregularity of a first doctor gap.

In general, the first regulation member 2 faces the regulation pole N2, and is disposed to maintain constant the first doctor gap DG between the developing roller 1 and the first regulation member 2. As illustrated in FIG. 4, a gap gauge is located at a central portion or both end portions of the developing roller 1, and a coupling member, for example, a screw, is coupled to each of both end portions of the first regulation member 2. Due to a rotational force generated when the screw is coupled, the both end portions of the first regulation member 2 are pressed downward. Accordingly, the first regulation member 2 is deformed as indicated by a dashed line of FIG. 4, and thus the first doctor gap DG is less at the both end portions of the developing roller 1 than at the central portion of the developing roller 1. Then, a thickness of the developer layer at the both end portions of the developing roller 1 is less than that of the central portion of the developing roller 1, and a density at both end portions of a printed image is less than a density at a central portion of the printed image, thereby leading to image density irregularity. To solve the problem, shapes of the both end portions of the first regulation member 2 may be changed or a shape of the outer circumferential surface of the developing roller 1, particularly, the sleeve 11, may be changed such that the central portion and the both end portions are stepped, in order to make constant the first doctor gap DG at the central portion and the both end portions in consideration of the deformation of the first regulation member 2. However, it is not easy to precisely change the shapes of the both end portions of the first regulation member 2 and the shape of the outer circumferential surface of the sleeve 11 in consideration of the amount of the deformation, and component processing costs may be increased.

Referring to FIGS. 2 and 3, the problem is solved by disposing a second regulation member 5 on an upstream side of the first regulation member 2 in a rotational direction of the developing roller 1. The second regulation member 5 faces the regulation pole N2 like the first regulation member 2, and includes a second regulating portion 51. There is a second doctor gap G between the outer circumferential surface of the developing roller 1 and the second regulating portion 51. The second regulation member 5 disposed on the upstream side of the first regulation member 2 allows pressures and densities of the developer to be uniformly distributed to compensate for irregularity of the first doctor gap DG, and thus enables the developer layer after passing through the first doctor gap DG to be formed to a uniform thickness on the outer circumferential surface of the developing roller 1.

A thickness of the developer layer at the development area may be represented by using a weight of the developer per unit area of the outer circumferential surface of the developing roller 1, that is, a developer mass per area (DMA). In order to obtain a high-quality printed image, the DMA may be adjusted to range from, for example, about 20 mg/cm$^2$ to about 90 mg/cm$^2$ by ranging the first doctor gap DG from about 0.25 mm to about 0.7 mm. However, as described above, since the first doctor gap DG formed by the first regulation member 2 is less at the both end portions than at the central portion, the DMA is less at the both end portions than at the central portion of the developing roller 1.

Figure 5:
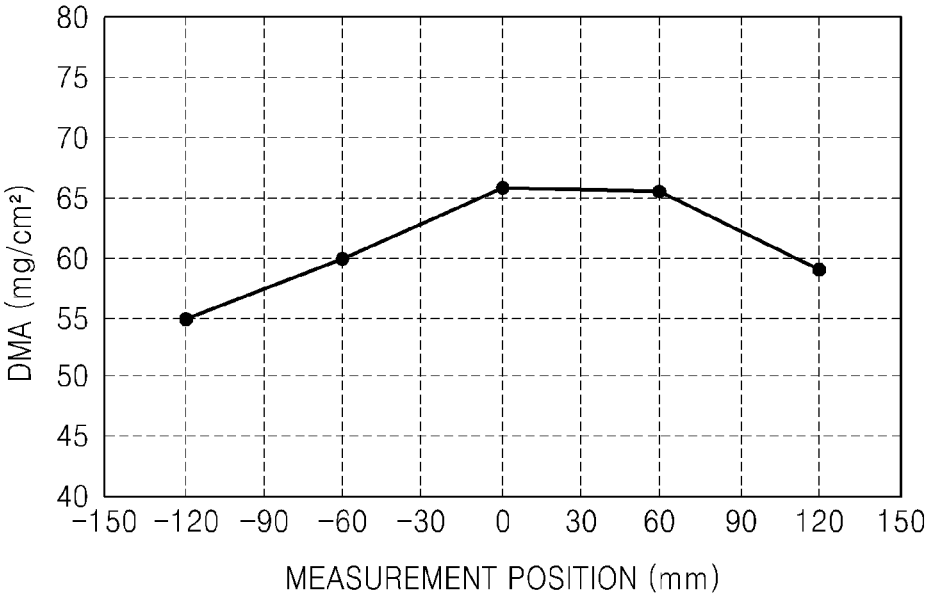
FIG. 5 is a graph illustrating a relationship between a developer mass per area (DMA) and the first doctor gap.
Figure 6:
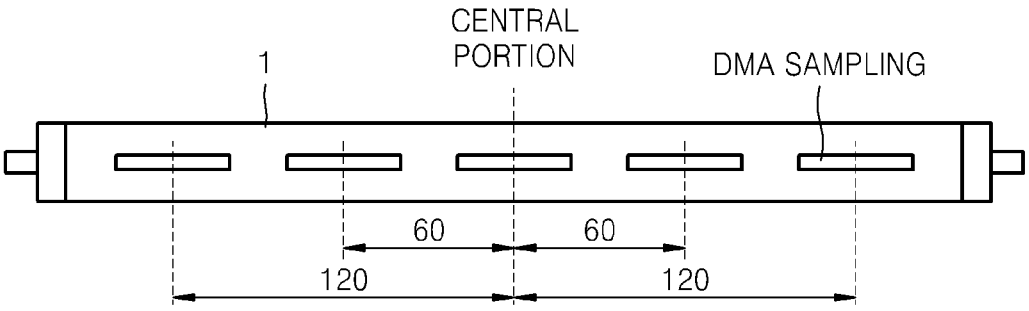
FIG. 6 is a cross-sectional view illustrating DMA measurement positions.

FIG. 5 is a graph illustrating a relationship between the DMA and the first doctor gap DG. The second doctor gap G is the same at the central portion and the both end portions. Measurement conditions are as follows.

first doctor gap: 0.6 mm (at central portion), 0.55 mm (at both end portions)

second doctor gap: 2.2 mm (at central portion and both end portions)

temperature and moisture: 23° C. and 40%
process speed: 141 mm/sec (28 ppm/A4)
outer diameter of developing roller: 18.2 mm
outer diameter of photosensitive drum: 30 mm
linear velocity ratio between developing roller and photosensitive drum: 1.4
average diameter of toner: 6.7 μm
average diameter of carrier: 38 μm
amount of developer: 345 g
concentration of toner: about 7%
average charge amount of developer: −60 μC/g
development gap: 0.40~0.45 mm A charge amount is a value measured by using an electric field ratio equation-based charge amount measurement device (made by DIT Co., Ltd.) at 2.8 kV and 2000 rpm for 30 seconds. The DMA is a value measured by using a precise scale by absorbing the developer of a 5×40 mm-area at the central portion of the developing roller 1, and at points 60 mm and 120 mm from the central portion toward the both end portions. The DMA is a value obtained by averaging three measurement values.

Referring to FIG. 5, when the second doctor gap G is the same at the central portion and the both end portions, the DMA at the both end portions is less than the DMA at the central portion due to irregularity of the first doctor gap DG.

Figure 7:
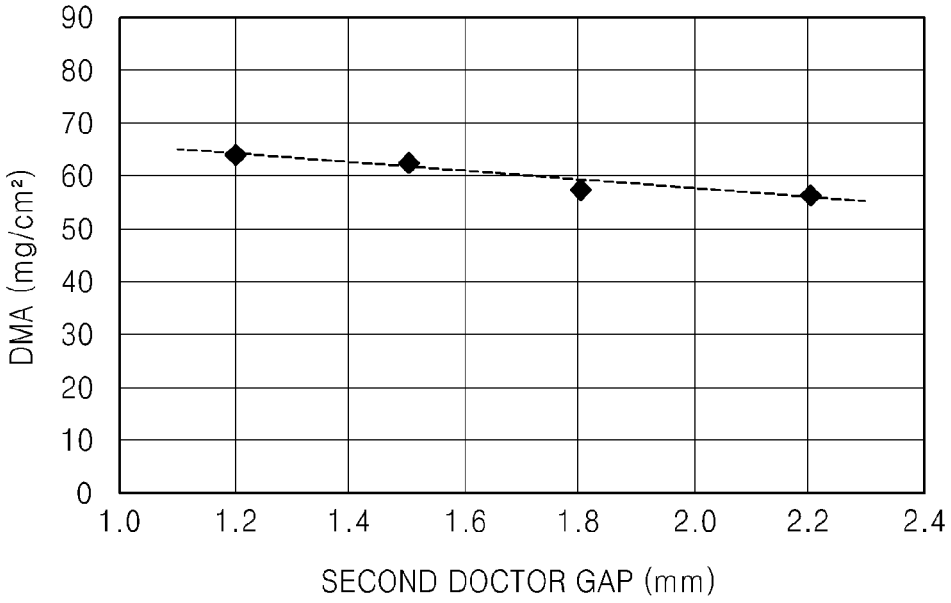
FIG. 7 is a graph illustrating a relationship between the DMA and a second doctor gap.

FIG. 7 is a graph illustrating a relationship between the second doctor gap G and the DMA at the both end portions of the developing roller 1. Referring to FIG. 7, when the first doctor gap DG at the both end portions is set to 0.55 mm and the second doctor gap G is changed to 1.2 mm, 1.5 mm, 1.8 mm, and 2.2 mm, it is found that the DMA at the both end portions of the developing roller 1 is gradually reduced. That is, the DMA increases as the second doctor gap G decreases, and the DMA decreases as the second doctor gap G increases. This is because as the second doctor gap G decreases, the developer concentrates on the second doctor gap G, a pressure and a density of the developer around the first doctor gap DG are increased, and the developer in this state passes through the first doctor gap DG.

After sequentially passing through the second doctor gap G and the first doctor gap DG, a packing density (PD) of the developer in the development area is shown in Table 1.

TABLE 1

| | | Second doctor gap = 1.5 mm | Second doctor gap = 2.2 mm |
|---|---|---|---|
| Toner concentration (Tc) | % | 7.0 | 7.0 |
| DMA | $mg/cm^2$ | 629 | 57 |
| Toner true density (Dt) | $mg/cm^3$ | 1100 | 1100 |
| Carrier true density (Dc) | $mg/cm^3$ | 4400 | 4400 |
| First doctor gap | cm | 0.055 | 0.055 |
| Packing density (PD) | % | 31.5 | 28.5 |

A PD is calculated as follows.

$$PD = \frac{\frac{Tc}{100} \times \frac{DMA}{Dt} + \frac{(100 - Tc)}{100} \times \frac{DMA}{Dc}}{\text{development gap}} \times 100$$

It is found that the PD when the second doctor gap G is 1.5 mm is about 10% higher than the PD when the second doctor gap G is 2.2 mm. A high PD means that a pressure and a density of developer in the development area are high. That is, when the PD is high, this means that a space occupied by the developer in the development area is large and a space occupied by air is small, compared to those when the PD is low. The possibility of toner scattering may be reduced by reducing the space occupied by the air.

From the above test, it is found that the DMA at the both end portions may be adjusted by adjusting the second doctor gap G. That is, irregularity of the DMA due to irregularity of the first doctor gap DG may be solved by making the second doctor gap G at the central portion different from the second doctor gap G at the both end portions.

Figure 8:
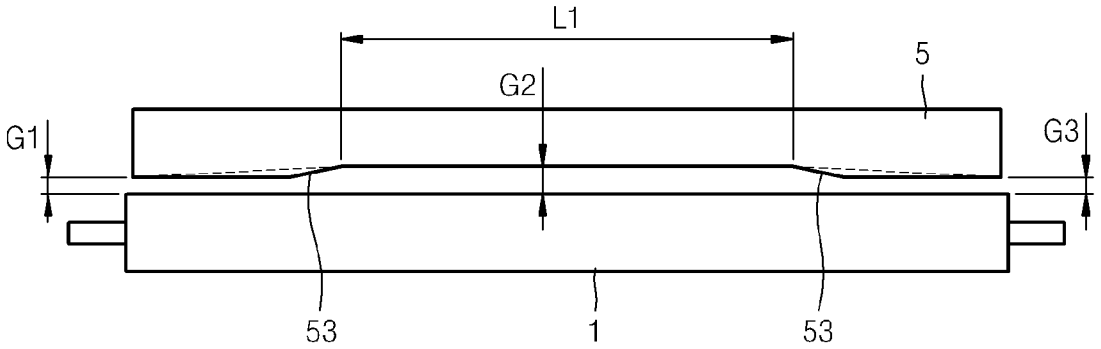
FIG. 8 is a cross-sectional view illustrating the second doctor gap.

Since the first doctor gap DG at the both end portions is less than the first doctor gap DG at the central portion, as illustrated in FIG. 8, a pressure and a density of the developer at the both end portions may be increased to be higher than those at the central portion by making the second doctor gap G at the both end portions less than that at the central portion. That is, when the second doctor gap at the central portion is G2 and the second doctor gap at the both end portions is G1 and G3, the following may be satisfied: G2>G1 and G2>G3. The second doctor gaps G1 and G3 may be equal to or different from each other.

Figure 9:
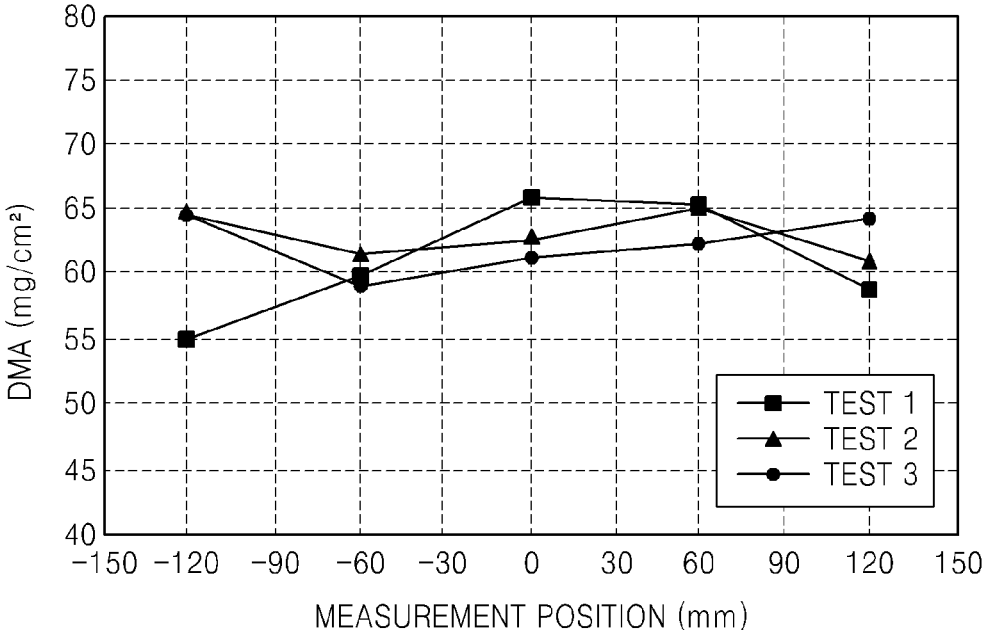
FIG. 9 is a graph illustrating a relationship between the DMA and the second doctor gap at both end portions.

FIG. 9 is a graph illustrating a relationship between the second doctor gap G and the DMA in the development area when tests 1, 2, and 3 are performed as shown in Table 2. The first doctor gap DG is 0.6 mm at the central portion and 0.55 mm at the both end portions. The test 1 is performed such that the second doctor gap G is the same at the central portion and the both end portions, that is, G1=G2=G3.

TABLE 2

| | G1 (mm) | G2 (mm) | G3 (mm) |
|---|---|---|---|
| Test 1 | 2.2 | 2.2 | 2.2 |
| Test 2 | 1.5 | 2.2 | 1.5 |
| Test 3 | 1.2 | 2.2 | 1.2 |

Figure 10:
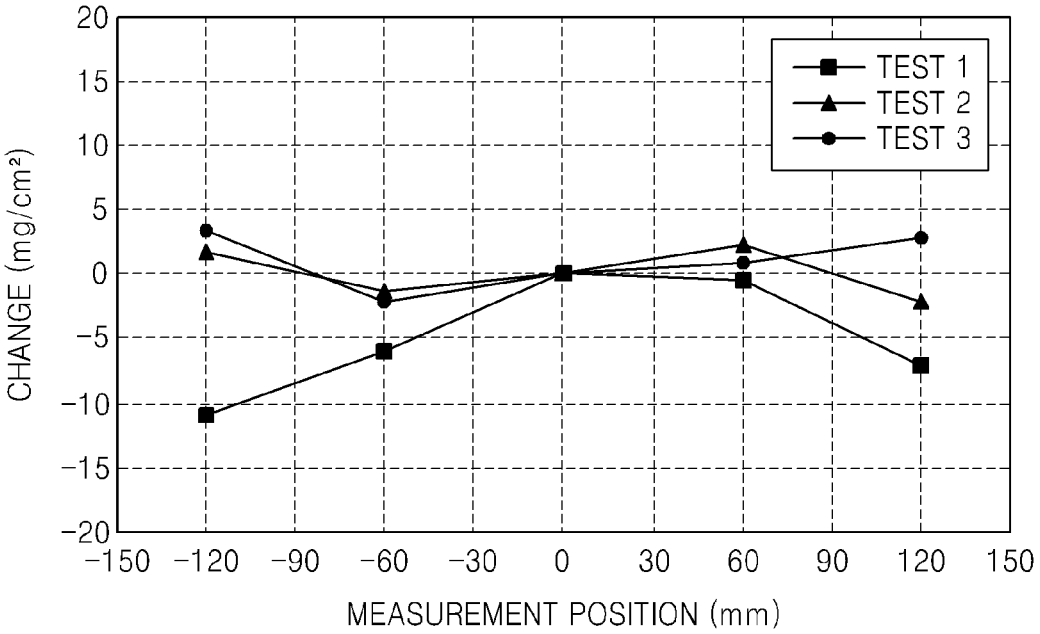
FIG. 10 is a graph illustrating a change in the DMA at the both end portions when the DMA at a central portion is set 0.

Referring to FIG. 9, it is found that the DMA at the central portion in the test 1 is greater than the DMA at the central portion in the test 2, which is greater than the DMA at the central portion in the test 3. This is because as the second doctor gaps G1 and G3 at the both end portions decreases, a pressure and a density of the developer at the both end portions increase and a pressure and a density of the developer at the central portion decrease. FIG. 10 is a graph illustrating a change in the DMA at the both end portions when the DMA at the central portion is set to "0". Referring to FIG. 10, it is found that as compared to the test 1, in the test 2 and the test 3, the DMA at the both end portions is increased and thus a difference between the DMA at the central portion and the DMA at the both end portions is reduced.

The tests 1, 2, and 3 are obtained when a process speed is 141 mm/sec, but the same result may be obtained even when the process speed is 90 mm/sec or 167 mm/sec.

FIG. 8 is a cross-sectional view illustrating the second doctor gap G. Referring to FIG. 8, a length L1 of a central portion of the second regulating portion 51 having the doctor gap G2 may be set to be greater than a width of minimum printing paper. For example, when the minimum paper from among standard sheets of paper is A5 paper (148×210 mm) or invoice paper (5.5×8.5 inch), the length L1 of the central portion may be set to about 160 mm.

When the second doctor gaps G1, G2, and G3 are less than the first doctor gap DG, since regulation of the developer layer occurs in the second doctor gaps G1, G2, and G3 and thus the first doctor gap DG becomes meaningless, the second doctor gaps G1, G2, and G3 need to be greater than the first doctor gap DG. Also, a difference between the second doctor gaps G1, G2, and G3 may be less than 1 mm. When the difference between the second doctor gaps G1, G2, and G3 is equal to or greater than 1 mm, a difference in a pressure and a density of the developer between the both end portions and the central portion is increased, thereby leading to a difference in an image density between a central portion and both end portions of a printed image.

The second doctor gaps G1 and G3 may be set to range from about 0.5 mm to about 2.0 mm. When the second doctor gaps G1 and G3 are less than 0.5 mm, a pressure of the developer is increased too much, thereby increasing a driving load of the developing roller 1 and degrading the performance of the developer. Also, when the second doctor gaps G1 and G3 are greater than 2.0 mm, the second doctor gap G2 is increased too much, a pressure and a density of the developer at the central portion are reduced too much, and there occurs irregularity in the amount of the developer in a direction in which the developer is delivered in the second area 120 by the second agitator 4, thereby leading to an image density difference in an inclined pattern, a so-called auger mark.

When a pressure and a density of the developer in boundary areas 53 between the central portion and the both end portions are drastically changed, image density irregularity may occur in the boundary areas 53 between the central portion and the both end portions of the printed image. Hence, as illustrated in FIG. 8, the second doctor gap G in each of the boundary areas 53 may be gradually changed from G2 to G1 and G3.

Although the second doctor gaps G1, G2, and G3 of the second regulation member 5 are changed in stepwise manner in FIG. 8, the present embodiment is not limited thereto. For example, as long as G2>G1 and G2>G3, the second doctor gap G indicated by a dashed line of FIG. 8 may be outwardly curved at the central portion.

Referring to FIG. 3, the second regulation member 5 is disposed on the upstream side of the second regulating portion 51, and includes a concave portion 52. A gap between the concave portion 52 and the outer circumferential surface of the developing roller 1 is greater than the second doctor gap G. The concave portion 52 forms a retrieval path through which a portion of the developer not passing through the first regulating portion 21 and the second regulating portion 51 is retrieved to the second area 120.

Figure 11:
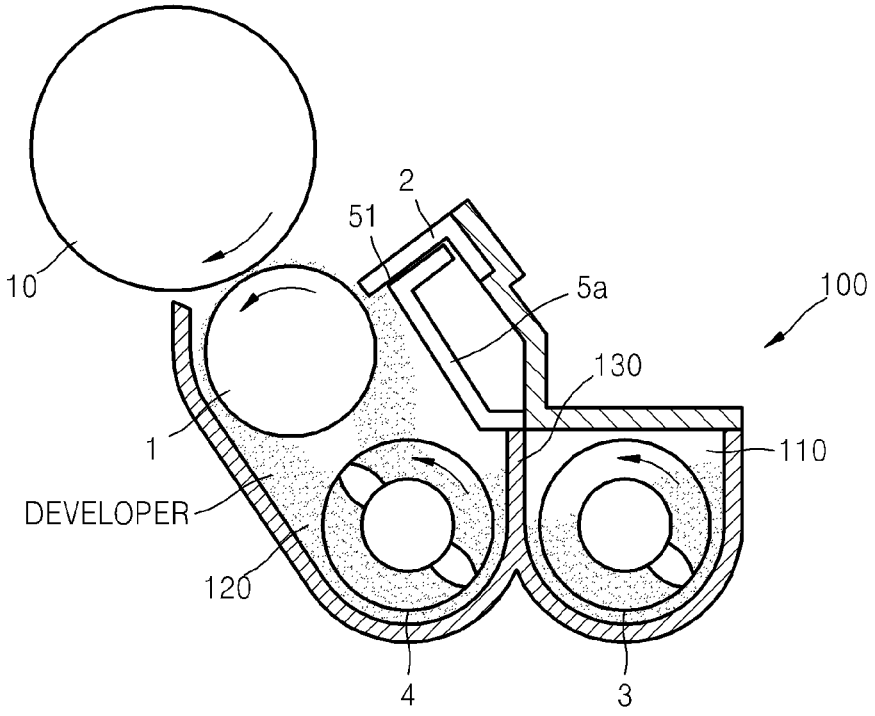
FIG. 11 is a cross-sectional view illustrating a modification of a second regulation member.

Although the second regulation member 5 includes the second regulating portion 51 and the concave portion 52 in FIG. 3, the present embodiment is not limited thereto. FIG. 11 is a cross-sectional view illustrating a modification of the second regulation member 5. As illustrated in FIG. 11, a second regulation member 5*a* includes the second regulating portion 51 and a straight portion that straightly extends from the second regulating portion 51 may provide the same effect as the second regulation member 5 of FIG. 3.

As described above, even when the first doctor gap DG at the both end portions is less than that at the central portion, the developer layer may be formed to a uniform thickness in a longitudinal direction of the developing roller 1 by making a pressure and a density of the developer at the both end portions higher than those at the central portion, and the risk of toner scattering may be reduced by increasing a PD of the developer in the development area and the first regulating portion 21.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing device to perform development by supplying toner in a developer, in which the toner and a carrier are mixed, to an electrostatic latent image formed on an image bearing member, the developing device comprising:

a development member which receives the developer on an outer circumferential surface thereof and supplies the toner to the image bearing member;

a first regulation member that comprises a first regulating portion to form a first doctor gap between the outer circumferential surface of the development member and the first regulating portion; and a second regulation member disposed on an upstream side of the first regulation member in a rotational direction of the development member and comprising a second regulating portion to form a second doctor gap between the outer circumferential surface of the development member and the second regulating portion, wherein the second doctor gap includes gaps formed at a central portion and both end portions, respectively, in a longitudinal direction of the development member, wherein the gap at the central portion is different than gaps at both end portions, such that the second doctor gaps at the both end portions correspond to end portions of the first regulation member to compensate for irregularity of the first doctor gap, wherein the developer passes the gaps at the central portion and both end portions and is supplied to the first doctor gap as the development member rotates, wherein the second doctor gaps at the both end portions are less than the second doctor gap at the central portion, the second doctor gaps at the both end portions and the second doctor gap at the central portion are greater than the first doctor gap, and wherein the second doctor gaps are all different sizes.

2. The developing device of claim 1, wherein the first regulating portion and the second regulating portion face a same magnetic pole of the development member.

3. The developing device of claim 1, wherein a difference between the second doctor gap at the central portion and the second doctor gaps at the both end portions is equal to or less than 1 mm.

4. The developing device of claim 1, wherein the second doctor gaps at the both end portions range from about 0.5 mm to about 2.0 mm.

5. A developing device to perform development by supplying toner of a developer, in which the toner and a carrier are mixed, to an electrostatic latent image formed on an image bearing member, the developing device comprising:

a development member which receives a developer on an outer circumferential surface thereof and supplies the toner to the image bearing member;

a first regulating portion to form a first doctor gap between the outer circumferential surface of the development member and the first regulating portion; and a second regulating portion disposed on an upstream side of the first regulating portion in a rotational direction of the development member to form different pressures of the developer at both end portions and a central portion in a longitudinal direction of the development member, such that the second regulating portion includes a second doctor gap between the outer circumferential surface of the development member such that end portions of the second regulating portion correspond to end portions of the first regulation member to compensate for irregularity of the first doctor gap, wherein the second doctor gap includes gaps formed at the central portion and at the both end portions, respectively, of the development member, wherein the developer passes the central portion and both end portions of the second doctor gaps and is supplied to the first doctor gap as the development member rotates, wherein the second doctor gaps at the both end portions are less than the second doctor gap at the central portion, the second doctor gaps at the both end portions and the second doctor gap at the central portion are greater than the first doctor gap, and wherein the second doctor gaps are all different sizes.

6. The developing device of claim 5, wherein the second regulation member forms the different pressures such that the pressure of the developer at the both end portions of the development member is higher than the pressure of the developer at the central portion of the development member.

7. The developing device of claim 6, wherein a difference between the second doctor gap at the central portion and the second doctor gaps at the both end portions is equal to or less than 1 mm.

8. The developing device of claim 7, wherein the second doctor gap at the both end portions range from about 0.5 mm to about 2.0 mm.

9. An electrophotographic image forming apparatus using a developer, in which toner and a carrier are mixed, the electrophotographic image forming apparatus comprising:

an image bearing member on which an electrostatic latent image is formed; and a developing device to perform development by supplying the toner to the electrostatic latent image formed on the image bearing member, the developing device comprising:

a development member which receives the developer to an outer circumferential surface thereof and supplies the toner to the image bearing member, a first regulation member that comprises a first regulating portion to form a first doctor gap between the outer circumferential surface of the development member and the first regulating portion, and a second regulation member disposed on an upstream side of the first regulation member in a rotational direction of the development member and comprising a second regulating portion to form a second doctor gap between the outer circumferential surface of the development member and the second regulating portion, wherein the second doctor gap includes gaps formed at a central portion and both end portions, respectively, in a longitudinal direction of the development member, wherein the gap at the central portion is different than the gaps formed at both ends, such that the gaps at the both end portions correspond to end portions of the first regulation member to compensate for irregularity of the first doctor gap, wherein the developer passes the gaps at the central portion and both end portions and is supplied to the first doctor gap as the development member rotates, wherein the second doctor gaps at the both end portions are less than the second doctor gap at the central portion, the second doctor gaps at the both end portions and the second doctor gap at the central portion are greater than the first doctor gap, and wherein the second doctor gaps are all different sizes.

10. The electrophotographic image forming apparatus of claim 9, wherein the first regulating portion and the second regulating portion face a same magnetic pole of the development member.

11. The electrophotographic image forming apparatus of claim 9, wherein a difference between the second doctor gap at the central portion and the second doctor gaps at the both end portions is equal to or less than 1 mm.

12. The electrophotographic image forming apparatus of claim 9, wherein the second doctor gaps at the both end portions range from about 0.5 mm to about 2.0 mm.

13. A developing device to supply toner in a developer to a photosensitive drum to form an image on a printing medium, the developing device comprising:

a developing roller having an outer circumferential surface which receives the developer and supplies the toner to the photosensitive drum;

a first regulation member to form a first doctor gap with the outer circumferential surface of the developing roller; and a second regulation member disposed upstream of the first regulation member to form second doctor gaps with the outer circumferential surface of the developing roller which second doctor gaps are larger than the first doctor gap, at least one of the second doctor gaps being different in size than the remaining second doctor gaps, such that the second doctor gaps at end portions of the second regulation member correspond to end portions of the first regulation member to compensate for irregularity of the first doctor gap, wherein the developer passes the second doctor gaps and is supplied to the first doctor gap as the developing roller rotates, wherein the second regulation member comprises a central portion to form the at least one of the second doctor gaps to be larger in size than the remaining second doctor gaps, and wherein the second doctor gaps are all different sizes.

14. The developing device of claim 13, wherein the second regulation member uniformly distributes pressure and density of the developer along a length of the outer circumferential surface of developing roller.

15. The developing device of claim 13, wherein the central portion is longer than a width of the printing medium.

16. A developing device to supply toner in a developer to a photosensitive drum to form an image on a printing medium, the developing device comprising:

a developing roller having an outer circumferential surface which receives the developer and supplies the toner to the photosensitive drum;

a first regulation member to form a first doctor gap with the outer circumferential surface of the developing roller; and a second regulation member disposed upstream of the first regulation member to forms second doctor gaps with the outer circumferential surface of the developing roller that are larger than the first doctor gap, at least one of the second doctor gaps being different in size than the remaining second doctor gaps, such that the second doctor gaps at end portions of the second regulation member correspond to end portions of the first regulation member to compensate for irregularity of the first doctor gap, wherein the developer passes the second doctor gaps and is supplied to the first doctor gap as the developing roller rotates, wherein the second regulation member comprises a central portion to form the one of the plurality of second doctor gaps larger in size than the remaining second doctor gaps, and wherein the second doctor gaps are all different sizes.

* * * * *